US005722130A

United States Patent [19]

Baader

[11] Patent Number: 5,722,130

[45] Date of Patent: Mar. 3, 1998

[54] PRESS-BUTTON-LIKE FASTENING APPARATUS

[75] Inventor: Hans-Joachim Baader, Wuppertal, Germany

[73] Assignee: Happich Fahrzeug-und Industrieteile GmbH, Wuppertal, Germany

[21] Appl. No.: 616,109

[22] Filed: Mar. 14, 1996

[51] Int. Cl.[6] ..... A44B 17/00

[52] U.S. Cl. ..... 24/662; 24/635; 24/640; 24/681

[58] Field of Search ..... 24/635, 634, 681, 24/662, 110, 640, 694

[56] References Cited

U.S. PATENT DOCUMENTS

| | | | |
|---|---|---|---|
| 1,433,798 | 10/1922 | Carr | 24/662 |
| 5,003,673 | 4/1991 | Nysten . | |
| 5,189,768 | 3/1993 | Riceman et al. . | |
| 5,369,856 | 12/1994 | Hauser | 24/62 X |
| 5,560,660 | 10/1996 | Tserng | 24/634 X |

FOREIGN PATENT DOCUMENTS

| | | | |
|---|---|---|---|
| 408806 | 1/1924 | Germany . | |
| 8915362 | 6/1990 | Germany . | |
| 3923043 | 1/1991 | Germany . | |
| 9014692 | 2/1991 | Germany . | |
| 213010 | 3/1924 | United Kingdom | 24/640 |
| 233182 | 5/1925 | United Kingdom | 24/694 |
| 258385 | 9/1926 | United Kingdom | 24/110 |

OTHER PUBLICATIONS

European Search Report filed 16 Apr. 1996.

*Primary Examiner*—Peter M. Cuomo
*Assistant Examiner*—Hanh V. Tran
*Attorney, Agent, or Firm*—Brinks Hofer Gilson & Lione

[57] ABSTRACT

A press-button device is provided that includes an upper part and lower part for fastening together fabric and other materials. The upper part has a hollow main part that includes a disc and a hollow central sleeve. Arranged within the main part are a compressible gripping connector within an outer gripping sleeve. A spring is positioned between the outer gripping sleeve and hollow central sleeve. A rivet secures the tops of the outer gripping sleeve and gripping connector to a button. A seal is provided between the button and the main part that protects the inside of the main part and permits axial movement of the button. The upper part also includes a plate positioned in the main part that carries a rigid annular sleeve with a conical-shaped interior surface that abuts against the end of the gripping connector. A washer secures the upper part to fabric or other material. The lower part includes a spherical undercut head for engaging the upper part gripping connector. The head is connected to a casing that is fastened to an outer disk. A fastening washer secures the lower part to the fabric or other material.

13 Claims, 3 Drawing Sheets

PRESS-BUTTON-LIKE FASTENING APPARATUS

BACKGROUND OF THE INVENTION

The invention relates to a press-button-like fastening apparatus. It includes an upper part consisting of a hollow main part. A compressible gripping means arranged within the main part is movable in the axial direction. A button arranged outside of he main part is connected with one end of the gripping means. A sleeve encompasses the gripping means and is connected to it. A spring encompasses the sleeve, exerts pressure in the axial direction on the gripping means and is supported between the abutment surfaces which are provided in the main part, or in the sleeve respectively. A rigid annular sleeve with an inner abutment connected to the main part serves as an abutment for the gripping means. The sleeve carries a washer for fixedly clamping a fabric or the like to the main part. The apparatus includes a lower part consisting of a spherical undercut head part, an outer disc grasping behind a fabric or the like and a washer clamping the fabric or the like against the outer disc.

Such a press-button-like fastening apparatus has been distributed by the assignee on a large scale for many years. The fastening apparatus is particularly suitable in cases where a quickly and easily detachable fastening which is also reliable under pressure is desired, e.g. for detachable carrying slings in portable record players, as a lid cover for containers or for securely fastening machine cases and convertible tops. The fastening apparatus is particularly suitable for connections in utensils for daily use which are to be opened and closed frequently, e.g., for securely fastening tarpaulins, tops and other covers.

A press-button-like fastening apparatus of the kind mentioned above is also known from DE 4 08 806.

It was previously assumed that the mechanism of the fastening apparatus is not susceptible to faults owing to its more or less complete encapsulation. Environmental pollution is continuously increasing, however, so that even press-button-like fastening apparatus of the kind discussed herein are subjected to corrosive influences, so that their lack of susceptibility to faults can no longer be ensured permanently.

BRIEF DESCRIPTION OF THE INVENTION

The invention is thus based on the object of improving a press-button-like fastening apparatus of the kind mentioned above with respect to its functioning over longer periods of time.

In order to achieve this object, according to the invention, the upper part and lower part of the fastening apparatus are protected by sealing means against the penetration of humidity and/or dirt into the interior of the upper part.

The sealing means according to the invention is to ensure such a substantial encapsulation of the fastening apparatus situated in the interior of the upper part that penetration of humidity or dirt particles is practically excluded.

The invention can be realized easily and inexpensively with different means. In accordance with one embodiment, the main part is provided with a sleeve having one end that merges into a disc, on which the button rests with its lower end. A sealing washer is arranged as a sealing means between the disc and the lower end of the button. This measure protects the part of the upper part of the fastening apparatus which is most endangered against penetration of humidity or dirt.

Preferably, a sealing washer is additionally buttoned over the spherical head part of the lower part. This washer is charged by the lower limiting surface of the annular sleeve of the upper part during the assembly of the upper and lower parts. In this way, corrosive materials can no longer easily reach the interior of the upper part through the connecting zone between the upper part and the lower part of the fastening apparatus.

In another embodiment for sealing the upper part, the button is provided with a sleeve part with a flange-like bend-off at the one end, around which a cap disc is folded. The sleeve part carries a sealing tube which is slipped on. One of the tube end seals the cap disc towards the flange-like bend-off and the other end rests in a sealing manner on the disc of the main part. In a further embodiment, the sealing tube may be a molded body with an enlargement at one end resting both on the flange-like bend-off and on the cap disc folded around it, and the other end has an annular groove in an enlarged zone, into which the sleeve part engages with the lower end zone.

Even further encapsulating of the interior of the upper part can be achieved by encompassing the button by a cap made from soft elastic rubber or plastic material whose end section rests on the disc of the main part. The cap made from soft elastic rubber or plastic material may, on the one hand, rest on the disc of the main part and, on the other hand, grasp around the circumferential edge of the disc. Preferably, the cap is arranged in a bellows-like manner in the grasping zone, so that the sealing is effective even in the event of any tilting between the upper part and the lower part of the fastening apparatus.

Finally, the washer of the lower part may be provided with a gasket with a sealing lip which can rest on the lower limiting surface of the annular sleeve of the upper part.

BRIEF DESCRIPTION OF THE DRAWINGS

Embodiments of the invention are explained below in detail by reference to the enclosed drawings, wherein.

DESCRIPTION OF THE PREFERRED EMBODIMENTS

Figure 1:
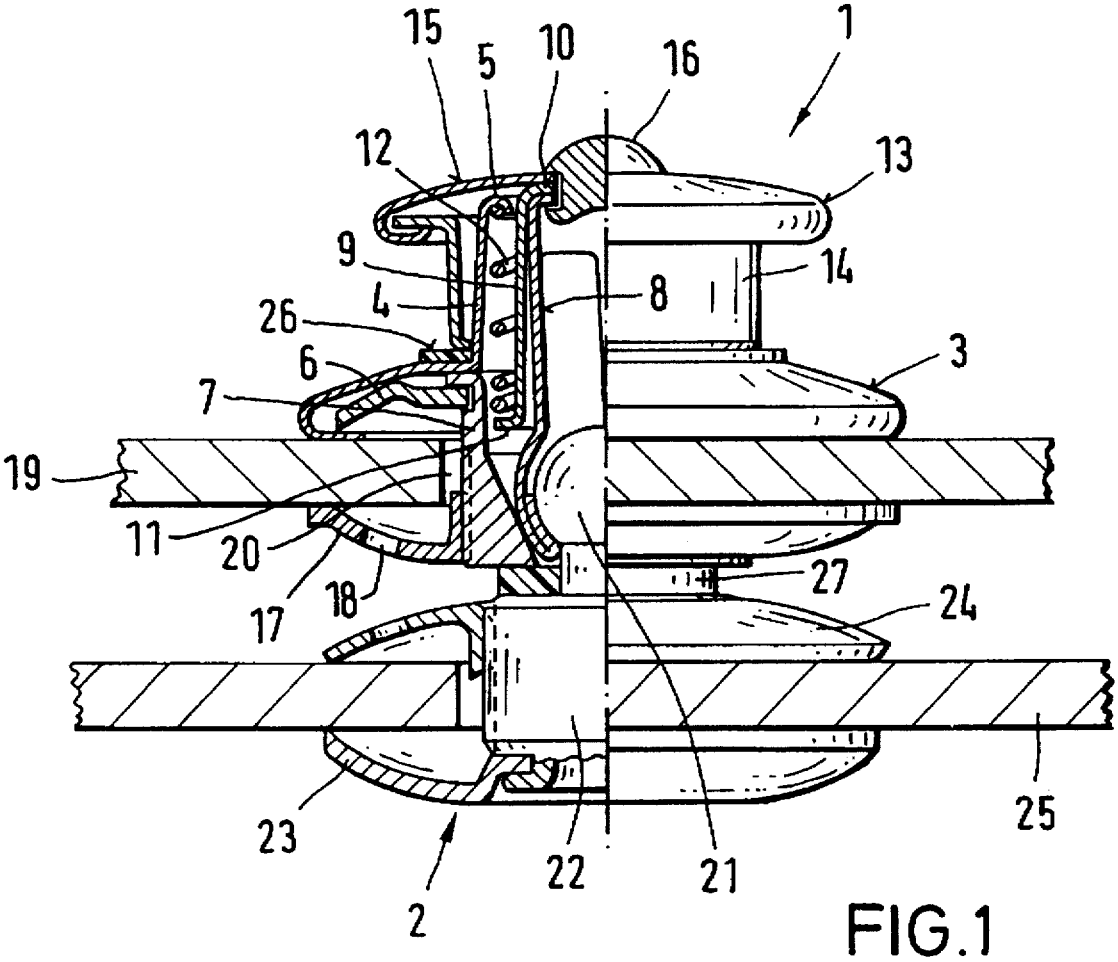
FIG. 1 shows the entire press-button-like fastening apparatus which consists of an upper and lower part and comprises sealing means.

The press-button-like fastening apparatus consists of an upper part 1 and a lower part 2. The upper part has a hollow main part. The hollow main part includes a disc 3 and a hollow central sleeve 4. The upper end of the sleeve 4 is bent inwardly in order to form a narrow shoulder ring 5. A plate 6 is attached to the inner side of disc 3 by bending the outer edge of disc 3. The plate 6 carries a rigid angular sleeve 7 whose inner space tapers conically from the top to the bottom in relation to the drawing. A gripping means 8 is arranged within the parts 3 and 7. The gripping means has the shape of a bowl and is provided with slots at several positions of the major part of its length, so that it is resilient at the one lower end. The gripping means 8 is arranged at the resilient end with a hollow round expansion. The end of gripping means 8 is provided with a central bore. An outer sleeve 9 is provided in connection with gripping means 8. The sleeve has a closed front wall 10 which is provided with a central bore and is equipped with an outer flange 11 at the opposite end. Sleeve 9 carries a spring 12, which is a spiral spring which rests on flange 11 of sleeve 9 and on shoulder ring 5 of sleeve 4.

Sleeve 4, spring 12 and gripping means 8 are overlapped from above by a button 13 which is formed by a sleeve part 14 with an outwardly bent flange and a cap disc 15 which is flanged around the flange. Button 13 is rigidly connected both to the front wall 10 of sleeve 9 as well as the front wall of gripping means 8 by means of a rivet 16.

As a result of the pressure exerted by spring 12 on sleeve 9 in the direction of its longitudinal axis, the free end of the resilient gripping means 8 is pressed against the inner surface of sleeve 7 which tapers downwardly in a conical manner and the outer end of the resilient gripping means 8 is compressed as a result of this. Pulling up on button 13 causes the sleeve 9 and the gripping means 8 to be moved in the axial direction against the force of spring 12, which leads to a retraction of gripping means 8 with respect to the conical sleeve 7 with which it cooperates. As a result, the free hollow round end of gripping means 8 is given the opportunity to expand.

A washer 17 cooperates with the disc 3. The washer also belongs to the upper part 1 of the fastening apparatus. The washer is thus movable in a longitudinal direction on sleeve 7 in that the sleeve 7 is provided with an outer thread and the washer 17 is provided with a bore with an inner thread which mates with the outer thread of the rigid annular sleeve. The washer 17 is provided with working surfaces, e.g., in the form of insert openings 18 for a screwing tool so that the washer can be moved against or toward the disc 3 in order to clamp a fabric 19 between the disc 3 and the washer 17. The term "fabric" is understood in the widest sense and includes convertible tops and tarpaulins as well as body sheets for vehicles, for example. Fabric 19 has a hole 20 so that washer 17 can be fixed to sleeve 7 by being screwed on.

The lower part 2 of the fastening apparatus includes a spherical undercut head part 21 having a shoulder or the like. The resilient compressible gripping means 8 of the upper part can project beyond and below the head part. The head part 21 comprises a casing part 22 with an outer disc 23 attached on it and with an outer thread for screwing on the washer 24 which like washer 17 tightly clamps a web of fabric 25, with fabric being understood in the widest sense, against the disc 23.

To use the fastening apparatus, the one part is guided over the other under pressure and the lower part 2 is tightly held by the resilient gripping means 8 in the upper part 1. To detach the parts from one another again, the button 13 is pulled outwardly, which causes the resilient gripping means 8 to be released from the other part encompassing it.

Despite its sturdy arrangement, the sliding and spring mechanism of the fastening apparatus is to be protected against aggressive humidity and soiling, because corrosion and/or soiling could gradually impair the function of the fastening apparatus over time.

For this purpose a sealing washer 26 is provided in FIG. 1 between the disc 3 and the lower end of button 13 which rests the washer. The force of spring 12 ensures that the lower button end is pressed permanently against the sealing washer 26, so that no humidity or dirt can reach the interior of the upper part through the gap between the lower button end and the disc 3.

FIG. 1 shows further sealing means in the connecting zone between the upper part 1 and the lower part 2, in the form of a sealing washer 27 which is buttoned over the head part 21 of the lower part 2. In joining the upper part 1 and the lower part 2, the sealing washer 27 is pressed on or charged by the lower limiting surface of the sleeve 7 which is arranged as an annular body.

Figure 2:
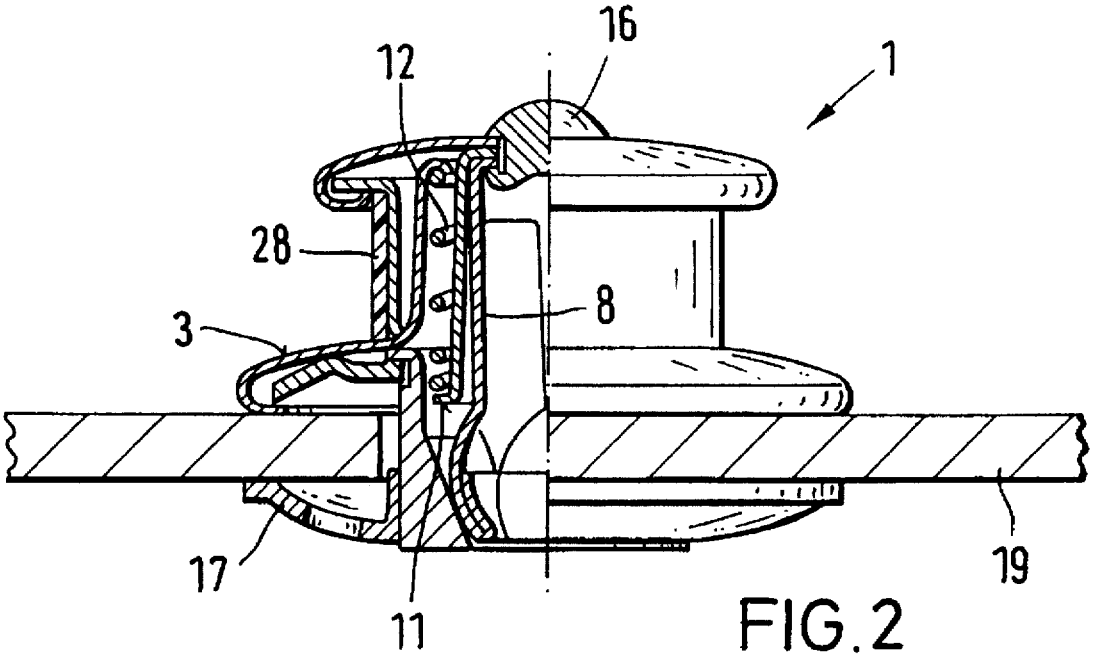
FIG. 2 shows the upper part of the fastening apparatus in accordance with FIG. 1 with a sealing means which is modified with respect to FIG. 1.

In FIG. 2, the sealing means consists of a sealing tube 28 which is pushed over the sleeve part 14 of button 13. One part of the sealing tube 28 seals the disc part 15 against the flange-like bend-off, whereas the other end rests on the flange or the disc 3 and assumes a sealing function here.

Figure 3:
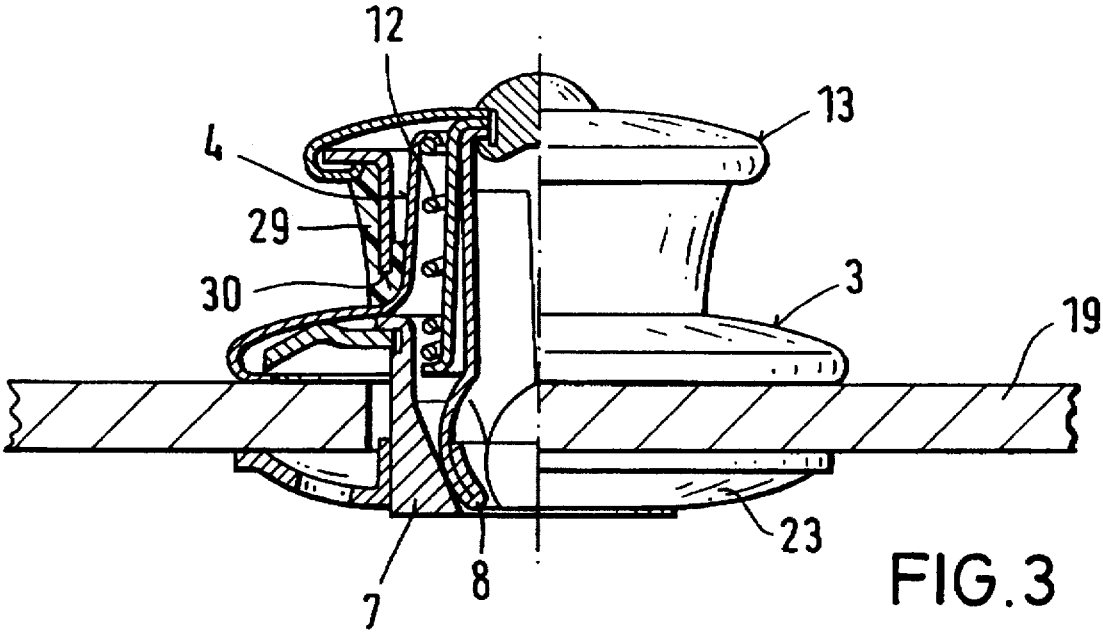
FIG. 3 shows the upper part of the fastening apparatus in accordance with FIG. 1 with a sealing means which is optimized with respect to FIG. 2.

The sealing tube 28 in FIG. 2 is replaced in FIG. 3 with a molded body 29. At its upper end, the molded body has an enlargement resting both on the flange-like bend-off as well as on the cap disc 15 of button 13 which is folded around it. At the other lower end, the molded body 29 includes an enlargement with an annular groove 30, in which the lower end section of the sleeve part 14 engages.

Figure 4:
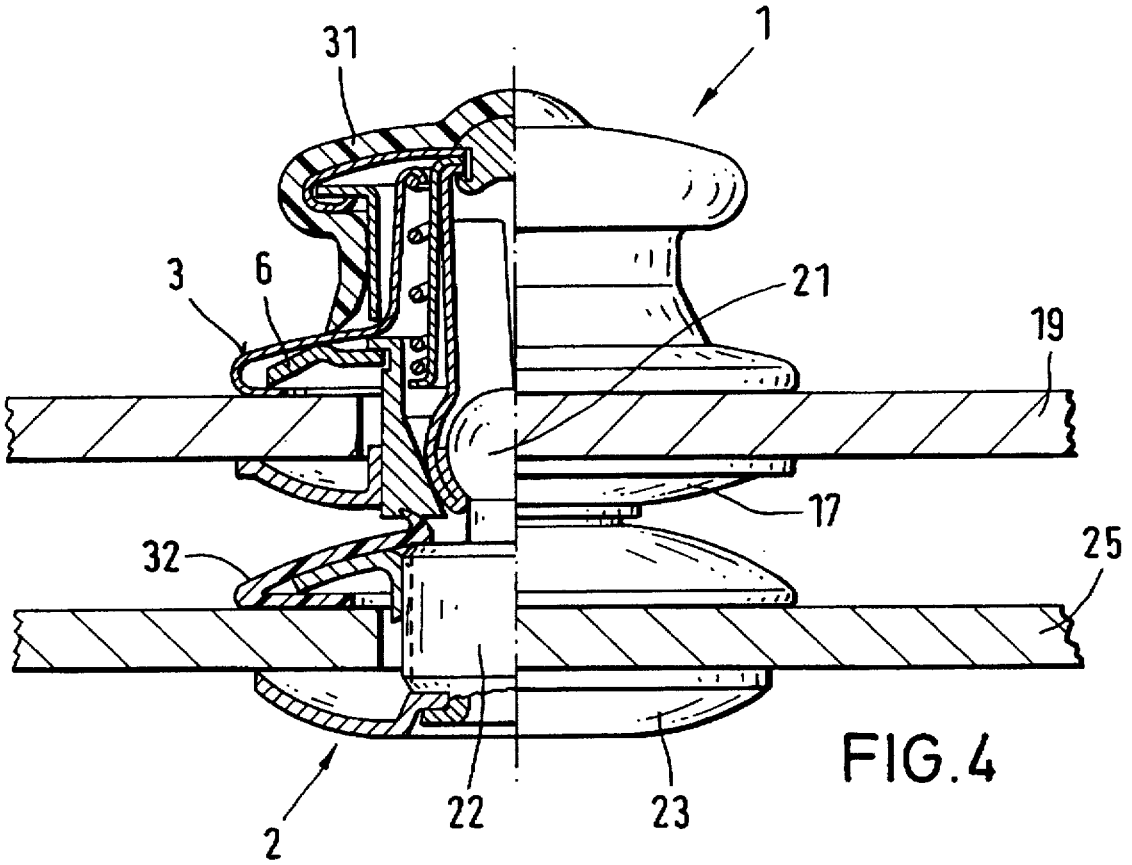
FIG. 4 shows the entire press-button-like fastening apparatus consisting of the upper and lower parts, provided with sealing means in embodiments which are modified with respect to FIG. 1.

In FIG. 4, the upper part 1 of the fastening apparatus includes a cap 31 which encompasses the button 13 which consists, like parts 26 to 29, of a soft elastic rubber or plastic material. The free end zone of cap 31 rests on disc 3 of the upper part 1. Cap 31 seals any gaps between the button 13 and the disc 3 as well as gaps between the sleeve part 14 and the disc part 15 of button 13 and any gaps in the zone of rivet 16.

In FIG. 4, the lower part 2 has a sealing means, in which the washer 24 of the lower part 2 is provided with a gasket 32 which includes a sealing lip which can rest on the lower limiting surface of sleeve 7 of the upper part 1.

Figure 5:
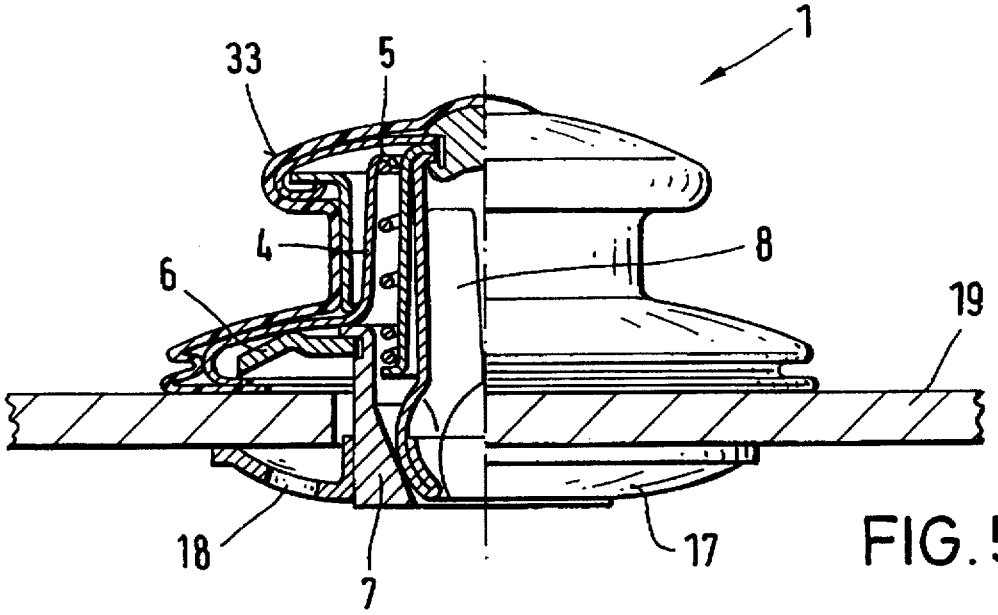
FIG. 5 shows the upper part of the fastening apparatus with a sealing means encapsulating the same nearly entirely.

FIG. 5 finally shows a sealing means for the upper part 1 of the fastening apparatus which consists of a cap 33 which is made from soft elastic rubber or plastic material and which grasps around button 13 as well as the circumferential edge of disc 3. Cap 33 is arranged in the grasping zone of disc 3 in form of a bellows and can thus follow the movement of button 13 when it is moved against the force of spring 12.

I claim:

1. A press-button-like fastening apparatus including:

an upper part fastened to a first fabric by the upper part extending through a first hole in the first fabric and gripping the first fabric on opposite sides of the first fabric and around the first hole;

the upper part of the apparatus comprising a hollow main part; the main part having a top end away from the first fabric and a bottom end toward the first fabric, the top end having a first abutment surface;

gripping means disposed in the main part and movable in the axial direction of the main part, the gripping means also being radially inwardly compressible with respect to the axis of the main part;

a button at the outside of the top end of the main part, the gripping means having a top and engaged by the button, such that pressing in or moving out the button respectively presses in or moves out the gripping means axially along the main part;

a first sleeve extending around the gripping means and having a top end connected thereto at least at the top end of the gripping means, the first sleeve having a second abutment surface at the bottom end;

a spring around and engaging on the outside of the first sleeve for exerting pressure thereon in the axial direction, wherein the spring is pressed between the first and second abutment surfaces, and the abutment surfaces are so positioned that the spring presses the first sleeve and the attached button to move inward toward the first fabric;

a second annular sleeve disposed around the gripping means and extending through the first hole and including a radially inwardly facing abutment positioned for engaging and urging the gripping means radially inward as the gripping means is urged along with the first sleeve toward the first fabric;

a plate disposed within the bottom end of the hollow main part, the plate having a concentric bore whereat the plate engages the second annular sleeve;

a first washer below the first fabric and on the opposite side of the first fabric from the button, the first washer being for clamping the first fabric toward the main part; the main part including a portion thereof above the first fabric for being urged toward the first washer, thereby to grip the first fabric between the first washer and the main part;

sealing means for sealing and protecting the upper part against penetration of humidity and dirt into the interior of the upper part, the sealing means being positioned on the exposed surface of the upper part to seal a gap between the button and the hollow main part;

the fastening apparatus further comprising a lower part disposed beneath the first fabric, the lower part including an upstanding head part which extends toward the gripping means, so that when the gripping means is moved by the force of the spring against the radially inwardly facing abutment, the gripping means is moved radially inwardly to grip the head part on the lower part of the fastening apparatus;

the griping means and the head part being respectively so shaped that as the gripping means is urged radially inwardly by the second sleeve, the head part of the lower part is drawn up into the main part while the button is urged axially downward toward the first fabric being gripped;

the lower part of the fastening apparatus extending through an opening through a second fabric to be gripped; the lower part including a second washer above the second fabric and including an outer disc below the second fabric, the second washer and the outer disc being placed for gripping the second fabric between them while the head part of the lower part is gripped in the gripping means, so that the upper and lower parts together hold the first and second fabrics.

2. The fastening apparatus of claim 1, wherein the head part of the lower part of the fastening apparatus comprises a spherical undercut head part and the gripping means of the upper part is shaped so that when the gripping means is urged inwardly by the second annular sleeve, the gripping means engages the spherical undercut head part.

3. The fastening apparatus of claim 1, wherein the main part further comprises a third sleeve having a lower end, and a disc at the lower end of the third sleeve shaped and positioned for resting on the upper side of the first fabric and opposing the first clamping washer;

the button including means pressing on the disc such that with the spring acting on the button to urge it toward the fabric, the button in turn acts on the disc to urge it against the fabric;

the sealing means comprising a sealing washer between the disc above the fabric and the means of the button pressing on the disc for sealing against entry of material past the disc and inside the button, thereby for sealing the upper part.

4. The fastening apparatus of claim 3, further comprising a second sealing washer around the head part of the lower part of the fastening apparatus and disposed between the upper part and the lower part of the fastening apparatus and being engaged by the second annular sleeve of the upper part, such that with the gripping means engaging the head part of the lower part, the second annular sleeve of the upper part is urged against the second sealing washer for sealing the upper part.

5. The fastening apparatus of claim 1, further comprising a second sealing washer around the head part of the lower part of the fastening apparatus and disposed between the upper part and the lower part of the fastening apparatus and being engaged by the second annular sleeve of the upper part, such that with the gripping means engaging the head part of the lower part, the second annular sleeve of the upper part is urged against the second sealing washer for sealing the upper part.

6. The fastening apparatus of claim 1, wherein the button includes a sleeve with a flange-like bend at the end of the button away from the first fabric; and a cap disc being folded around the flange-like bend-off of the button.

7. The fastening apparatus of claim 6, wherein the sleeve of the button further includes a sealing tube having one end sealing to the cap disc towards the flange-like bend-off and having another end resting in a sealing manner on the disc of the main part, whereby the sealing tube comprises a further part of the sealing means.

8. The fastening apparatus of claim 7, wherein the sealing tube has one end including an enlargement resting on the flange-like bend-off and on the cap disc folded around the bend-off, and wherein the other end of the tube is shaped to define an annular, upwardly open groove; the sleeve of the button having a lower end which engages in the groove thereby further comprising part of the sealing means.

9. The fastening apparatus of claim 1, further comprising the sealing means comprising a cap of a soft elastic material encompassing the button and extending down from the button to engage the disc at the first fabric.

10. The fastening apparatus of claim 9 wherein the cap rests on the disc of the main part and grasps around the circumferential edge of the disc, securing the cap over the disc and sealing the upper part.

11. The fastening apparatus of claim 10, wherein the cap further includes a bellows region in the grasping zone of the cap around the disc, whereby the cap may change in height dimension as the button moves, while the cap retains the seal of the upper part.

12. The fastening apparatus of claim 1, further comprising a gasket with a sealing lip located over the second washer of the lower part, the sealing lip of the gasket resting on the lower limiting surface of the main part of the upper part.

13. A press-button like fastening apparatus comprising an upper part and a lower part:

the upper part comprises:

a hollow main part having a top and bottom ends; the top end having a first spring abutment surface;

gripping means disposed in main part, movable in the axial direction of the main part and compressible in the radial inward direction;

a button at the outside of the top end of the main part, the button engaging a top end of the gripping means and being movable in the axial direction of the main part, the button and main part defining a gap where a bottom end of the button is proximate to the main part;

a first sleeve extending around the gripping means and being connected thereto, the first sleeve having a distal second spring abutment surface;

a spring encircling the outside of the first sleeve with opposing ends of the spring engaging the first and second spring abutment surfaces, respectively, such that the spring presses the first sleeve and attached button to move inwardly in the axial direction of the main part;

a plate engaging the interior bottom end of the hollow main part;

a second annular sleeve having a top end engaging the plate and a bottom end extending below the main part and including an inward conical abutment surface positioned for engaging and urging the gripping means radially inward as the gripping means is moved in the axial direction toward the lower part;

a first washer that engages the bottom end of the second annular sleeve;

sealing means for sealing and protecting the upper part against penetration of humidity and dirt into the interior of the upper part by sealing the gap between the button and the main part; and the lower part comprising an upstanding head part, a casing, a disc and a washer, the head part being attached to one end of the casing, the disc being attached to the opposite end of the casing and the second washer engaging the casing proximate to the head part;

wherein the head part extends toward the gripping means so that when the gripping means is moved by the force of the spring against the inward conical abutment surface, the gripping means is moved radially inward to grip the head part on the lower part of the fastening apparatus.

* * * * *